US005603882A

United States Patent [19]

Takano et al.

[11] Patent Number: 5,603,882

[45] Date of Patent: Feb. 18, 1997

[54] PIERCING METHOD AND APPARATUS

[75] Inventors: Yoshio Takano; Hiroki Fujitani, both of Miyagi; Takehiro Koga, Osaka-Hu, all of Japan

[73] Assignees: TDF Corporation, Tokyo-to; Kurimoto Ltd., Osaka-hu, both of Japan

[21] Appl. No.: 518,451

[22] Filed: Aug. 23, 1995

Related U.S. Application Data

[63] Continuation of Ser. No. 183,880, Jan. 21, 1994, abandoned.

[30] Foreign Application Priority Data

Jan. 26, 1993 [JP] Japan ..... 5-10702
Sep. 20, 1993 [JP] Japan ..... 5-233641

[51] Int. Cl.[6] ..... B26D 7/01; B26F 1/14

[52] U.S. Cl. ..... 264/155; 83/30; 83/684; 83/685; 425/295

[58] Field of Search ..... 264/153, 154, 264/155; 425/289, 295, 298, 301; 83/425, 454, 648, 681, 682, 684, 685, 30

[56] References Cited

U.S. PATENT DOCUMENTS

| | | | |
|---|---|---|---|
| 1,856,319 | 5/1932 | Cooper | 264/153 |
| 2,798,553 | 7/1957 | Berdan | 83/684 |
| 3,496,818 | 2/1970 | Porter et al. | 83/685 |
| 3,673,902 | 7/1972 | Strobel | 83/685 |
| 3,971,275 | 7/1976 | Mach | 83/454 |
| 4,281,546 | 8/1981 | Fraleigh | 264/153 |
| 4,905,556 | 3/1990 | Haack et al. | 83/685 |
| 5,054,353 | 8/1991 | Haack et al. | 83/685 |

FOREIGN PATENT DOCUMENTS

| | | | |
|---|---|---|---|
| 3235005 | 3/1984 | Germany | 264/153 |
| 3-243240 | 10/1991 | Japan . | |

*Primary Examiner*—Jay H. Woo
*Assistant Examiner*—Duane S. Smith
*Attorney, Agent, or Firm*—Evenson, McKeown, Edwards & Lenahan, P.L.L.C.

[57] ABSTRACT

The invention is directed to an improved method and apparatus for a forward extrusion piercing which is able to pierce a long through-hole of slenderness (length/hole diameter) 5 or the like in a hot blank with a high accuracy by one stroke of the piercing punch so as to produce hollow metallic products. In the process, a hot blank forged with a determined outer shape is set on a lower die, and an upper die assembly is provided with the piercing punch, a holding guide and an upper die coaxially with the lower die. Downward movement of the upper die assembly enables the holding guide to hold the blank and then the punch moves down with a retention by a through-hole of the holding guide through which the punch passes, against transverse displacement of the punch. The tip of the punch is adapted to enter a through-hole of a receiver die at its lower stroke end in order to cut off redundant piece of the blank.

9 Claims, 5 Drawing Sheets

PIERCING METHOD AND APPARATUS

This application is a continuation of application Ser. No. 08/183,880, filed on Jan. 21, 1994 now abandoned.

FIELD OF THE INVENTION

The present invention relates to an improved method and apparatus for forward extrusion hot-piercing of a forged blank having a determined shape with a shaft at one end thereof. Specifically, this piercing process will be desirably used for producing hollow metallic products of high slenderness, such as sleeve York of the drive shaft used in a truck, having an enlarged portion at one end thereof.

BACKGROUND OF THE INVENTION

In commonly accepted techniques, it is possible to produce hollow metallic products such as the aforementioned sleeve York in a process wherein a blank forged with a shaft at one end thereof, after being cooled, is drilled to form a hollow portion thereof. But, there are some defects in operation efficiency. Accordingly, hot piercing process has been employed. However, in piercing a blank which has an enlarged portion such as a branch of the sleeve York at one end thereof the so called backward extrusion piercing process, in which elongation of the blank occurs in the direction opposed to the piercing punch's forward direction, can not be used because the shape of such an enlarged portion la will be deformed during the piercing, as shown in FIG. 6.

Therefore, for piercing such a blank with an enlarged portion at one end thereof, a forward extrusion piercing process is used in which elongation of the blank occurs in the same direction as the punch's forward direction. However, in a conventional hot piercing process with forward extrusion, one stroke of the piercing punch can not form a through-hole, so that it is needed either (1) to cut off the bottom portion of blank to pass through, after piercing a blank except its bottom portion, or (2) to post-pierce the as yet not pierced bottom portion so as to pass through, after having pierced the blank except at its bottom portion. Thus, the problems described hereunder are accompanied in the process. Otherwise, there is seen Japanese Patent Laid-open No. 243240/1991, the entire disclosure of which is hereby expressly incorporated herein by reference, which discloses an improved forward extrusion piercing process, but this is for piercing cylindrical bodies and thus has different features from those of our invention.

As described above, since the prior art piercing process needs at least two strokes to form a through-hole, operation efficiency is low. Also, since the blank to be pierced is merely located in position on the lower die assembly, an enlarged portion of the blank will be deformed in the piercing process and further, as shown in FIG. 6, any narrow ring portion W will be caused at the stepped portion, or as shown in FIG. 7, (a) and (b), there will be caused a deformation of form Z or narrow ring W at the cylindrical portion of blank.

In particular, in piercing a blank of a slenderness (Pierced length/hole diameter) higher than 4, even prior art piercing can be employed, but it results in wider variation of worked dimensions owing to transverse displacement of the piercing punch. This leads to a low yield and occasionally to breakage or damage of the piercing punch. Accordingly, in the prior art, the piercing process has been used in a range of slenderness of less than 3, and for higher slenderness of blank, machining using a drill should be employed.

SUMMARY OF THE INVENTION

A principle object of the invention is to solve the above mentioned problems of the prior art piercing, and thus to provide an improved piercing method and apparatus which can pierce a forged blank having a shaft with higher slenderness and with higher working accuracy thereby to improve the yield, without any defects such as narrow rings or the like and without any deformation of an enlarged portion of the blank.

Another object of the invention is to provide an improved piercing method and apparatus which enables the piercing of higher slenderness to form a through-hole with one stroke of the piercing punch thereby to increase operation efficiency.

In order to attain the objects of the invention, a method according to the invention for piercing a hot blank positioned on a lower die assembly by the downward movement of the piercing punch attached to an upper die assembly with forward extrusion of the redundant piece, said blank forged as having a determined outer shape with a shaft at one end thereof, comprising lowering a holding guide disposed on the upper die assembly onto said lower die assembly just before the piercing; piercing said hot blank by the downward movement of said punch which passes through a through-hole of said holding guide, in the piercing stroke said through-hole of the holding guide serving to guide said piercing punch to thereby prevent transverse displacement of the same: applying backup pressure on the blank at the lower end thereof simultaneously with said piercing stroke; said application of backup pressure being done through a receiver die which receives said blank, the tip portion of the punch being adapted to enter a through-hole of said receiver die when the punch moves down to its lower end or a position adjacent thereto. The holding guide desirably holds an enlarged portion of the blank positioned on the lower die assembly when the guide is lowered onto said lower die assembly.

Also, an apparatus for forward extrusion piercing according to the invention, comprises a lower die assembly for supporting a blank forged as having a determined outer shape with a shaft at one end thereof, an upper die assembly located above the lower die assembly and having a piercing punch attached thereto for piercing the blank, and actuator means for driving said upper die assembly up and down, said upper die assembly having a holder member provided with a holding guide for holding uppermost positioned enlarged portion of said blank between said upper die assembly and said lower die assembly and a mounting member attached with the piercing punch, said mounting member being adapted to move up and down above said holder member, said holding guide being formed with a through-hole through which said piercing punch passes, said through-hole of the holding guide having a cross section slightly larger than the cross section of the punch so as to guide the piercing punch to prevent transverse displacement thereof, and said apparatus further comprising applying means located below said lower die assembly for applying backup pressure on said blank through a receiver die in the piercing stroke, said receiver die being adapted for up and down movement in the lower die assembly and having a through-hole co-axial with the through-hole of the holding guide so that the piercing punch enters the through-hole of the receiver die at its lower end or a position adjacent thereto.

Therefore, according to this piercing method, the piercing punch is guided and held with the through-hole of the holding guide so that any transverse displacement of the punch is hindered thus allowing a piercing for higher slenderness of a blank to be performed with high accuracy. Also, application of backup pressure on the blank prevents the blank from being deformed so as to avoid drawbacks such as narrow ring. Furthermore, prevention of the punch's transverse displacement enables the tip of the piercing punch to enter the through-hole with a suitable clearance of the receiver die, which leads to forming a through-hole in the blank by one stroke of the punch.

Also, according to the piercing apparatus of the invention, the upper die assembly includes a holder member provided with a holding guide and a mounting member for the piercing punch, said mounting member being adapted to move up and down relatively to and above the holder member, whereby upon descent of the holder member just before the piercing stroke, the holding guide holds an enlarged portion of the blank and thereafter the piercing punch moves down together with the mounting member to perform the piercing with the punch passing through the through-hole of the holding guide. In the piercing stroke, backup pressure is applied on the blank at the lower end thereof. Then, the through-hole of the holding guide prevents the piercing punch from being transversely displaced so that the tip of the punch is adapted to enter the through-hole of the receiver die at the lower end or a position adjacent thereto of the punch stroke, thereby to form a through-hole in the blank by one stroke.

Other objects, advantages and features of the present invention will be more readily appreciated and understood when considered in conjunction with the following detailed description and drawings.

BRIEF DESCRIPTION OF THE DRAWINGS

These and other aspects of the invention are apparent from the following drawings, in which:

FIG. 7 (*b*) illustrates a sectional view showing a blank pierced according to prior art.

DESCRIPTION OF THE PREFERRED EMBODIMENTS

All the disclosed embodiments can be made using conventional compounds and procedures without undue experimentation. All the disclosed embodiments are useful. The invention and advantageous details are explained more fully below with reference to exemplary embodiments and with the aid of the accompanying drawings.

Figure 1:
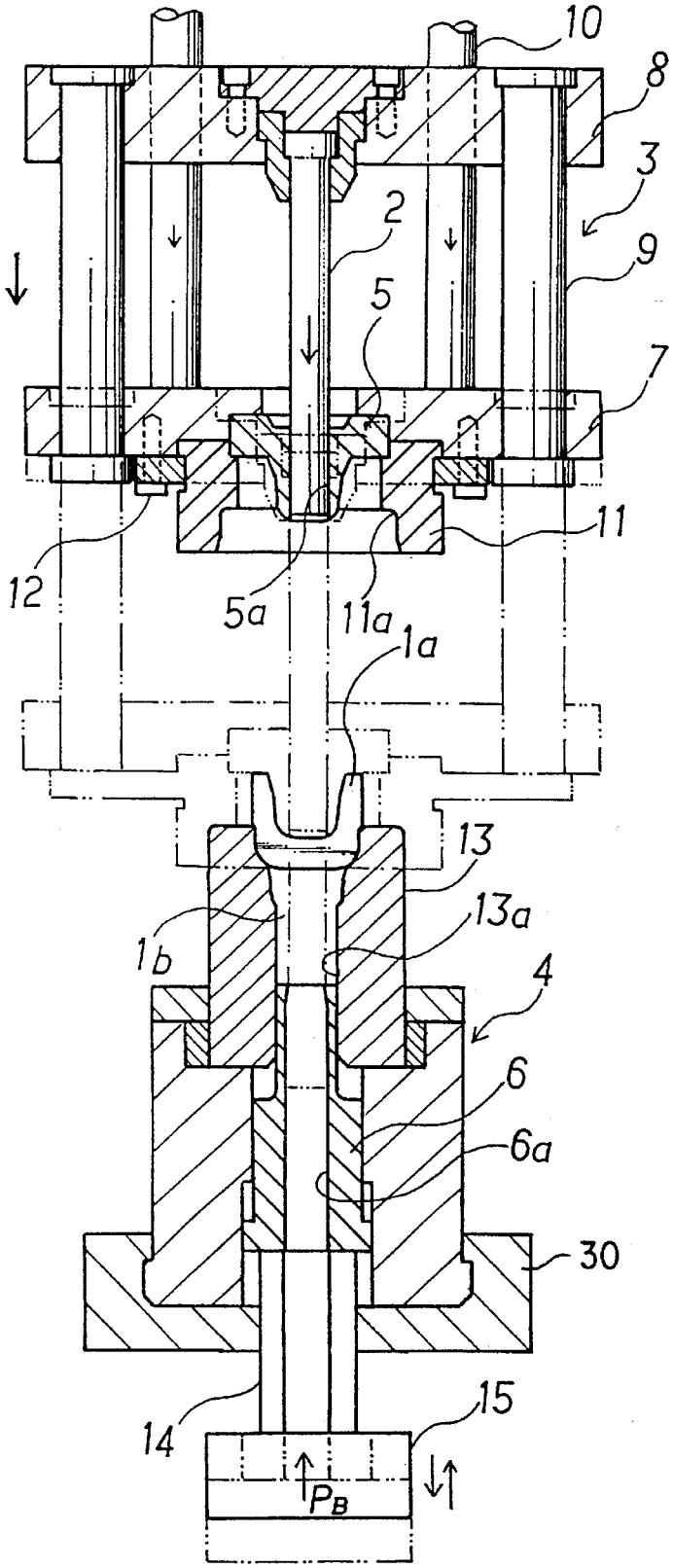
FIG. 1 illustrates a schematic view of an exemplified apparatus for carrying out a piercing process according to the invention.

FIG. 1 shows main portions of an example of apparatus used for carrying out the piercing process of the invention. The apparatus includes an upper die assembly 3 attached with the piercing punch 2, and a lower die assembly 4 for supporting a blank 1 to be pierced. The upper die assembly has a holding guide 5 which prevents the piercing punch from being displaced transversely. Also, a receiver die 6 with a vertical motion is provided in the lower die assembly in order to enable cutting off of redundant piece from the blank. The holding guide 5 is formed with a central through-hole 5*a* through which the punch 2 passes. For a blank or work to be pierced, a hot blank is used which has been forged to a determined outer shape with a shaft at one end thereof.

In the piercing process, the holding guide 5 is lowered onto the lower die assembly just before the punch piercing stroke. After that, the piercing punch 2 moves down to pierce the blank while it passes through the hole 5*a* of the holding guide 5, and simultaneously therewith backup pressure is applied on the lower end of the blank by way of the receiver die 6. Accordingly, the piercing punch 2 is guided with the through-hole 5*a* of the holding guide 5 during the piercing, so as to prevent any transverse displacement of the punch. The receiver die 6 has a center through-hole 6*a* formed axially thereof, and the piercing punch 2 is adapted to enter the hole 6*a* so as to effect punching (cutting off of redundant material) when the Punch 2 moves down to the lower stroke end or a position adjacent thereto.

The piercing punch 2 is vertically movable relative to the holding guide 5, and therefore the holding guide 5 is mounted on a holder member disposed on the upper die assembly, while the piercing punch 2 is mounted on a mounting member located on the upper die assembly. In the apparatus shown in FIG. 1, both such holder member and mounting member are movable, the former being comprised of lower plate 7 and the latter being above the lower plate and comprised of upper plate 8 which is vertically movable relative to the plate 7. These lower and upper plates 7, 8 are located by means of a suitable number of guide rods 9 to be movable relative to and in alignment with each other. 10 denotes connector rods which connect the lower plate 7 to an actuator.

The holding guide 5 will be fixed on a upper die 11 which is mounted on the lower plate 7. Also, this holding guide 5 will releasably be mounted on plate 7 for example by means that the said upper die 11 is secured with fitting screws 12. Such releasable mounting of the holding guide 5 provides an advantage that it can be easily exchanged. Shaft portion 1*b* of blank 1 fits into the center hole of lower die 13 mounted on the lower die assembly 4 so as to be set coaxial with the piercing punch 2.

The piercing punch 2 is coaxial with the hole 5*a* of the holding guide and the hole 6*a* of the receiver die, and the receiver die 6 is located below the lower die 13 and vertically movable in the center hole of the lower die assembly 4. This receiver die 6 can be loaded with an upward directed force by a backup pressure applying unit 15 by way of a tubular member 14 to apply backward pressure on the blank, and supports the blank in touch with the lower end of the same.

In the apparatus shown in FIG. 1, although actuators for the lower plate 7 and the upper plate 8 are omitted, oil cylinders are desirably used as such actuators because of simple arrangement and easy pressure control. As a matter of course, these actuators will be driven in a time determined relationship. Occasionally both the lower and upper plates 7, 8 will be driven by a common actuator. Also, an oil cylinder is preferably employed as the backup pressure applying unit 15.

Backup pressure Pb which is applied on the blank through the receiver die 6 in opposition to the piercing punch load Pp is less than the load Pp, whereas the load Pp should not exceed the sum of the backup pressure and the resisting force of the blank based on its yield strength in order to avoid any fracture and narrow ring of blank in piercing stroke. Therefore, where T denotes the resisting force of the blank, a relationship among Pp, Pb, and T is stipulated by the following formula and established.

$$Pp>Pb>Pp-T$$

Thus, such backup pressure Pb as limited by the above formula is to be applied.

Figure 3:
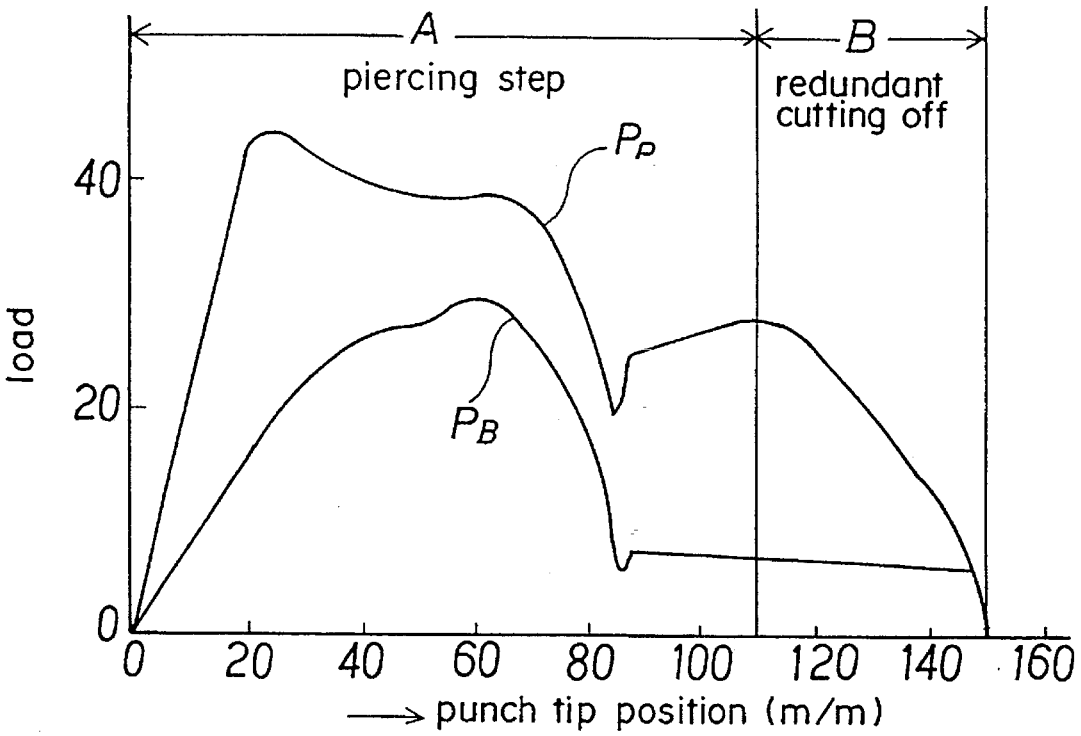
FIG. 3 illustrates a chart showing the exemplified relationship between the punch load and backup pressure in the piercing process.

As shown in FIG. 3, which shows an example of relation between the punch load Pp and the backup pressure Pb, the load Pp and pressure Pb are preferably nearly proportional to each other. In many cases, where the ratio of hole diameter dO of the blank (punch diameter) to diameter d1 of the shaft portion of the blank, i.e. d0/d1 exceeds 0.35, when a forward extrusion piercing is performed without application of the backup pressure, plastic deformation will be caused at the shaft portion of the blank. Accordingly, in case that the said ratio exceeds 0.35, the application of backup pressure is particularly useful, and a piercing process with the ratio $d0/d1 \leqq 0.9$ can be performed under control of the backup pressure.

In operation of the apparatus shown in FIG. 1, the lower plate 7 and the upper plate 8 will start simultaneously to move down, and the lower plate 7 is first lowered onto the lower die 13 of the lower die assembly 4 as shown in phantom line in FIG. 1, just before the piercing stroke (working stroke) so that the upper die 11 fits the lower die 13 and simultaneously therewith the holding guide 5 holds the enlarged portion la of the blank. Then the lower side of the holding guide 5 will desirably fit the said enlarged portion. Otherwise, the said lower side will press-form the enlarged portion.

Figure 2:
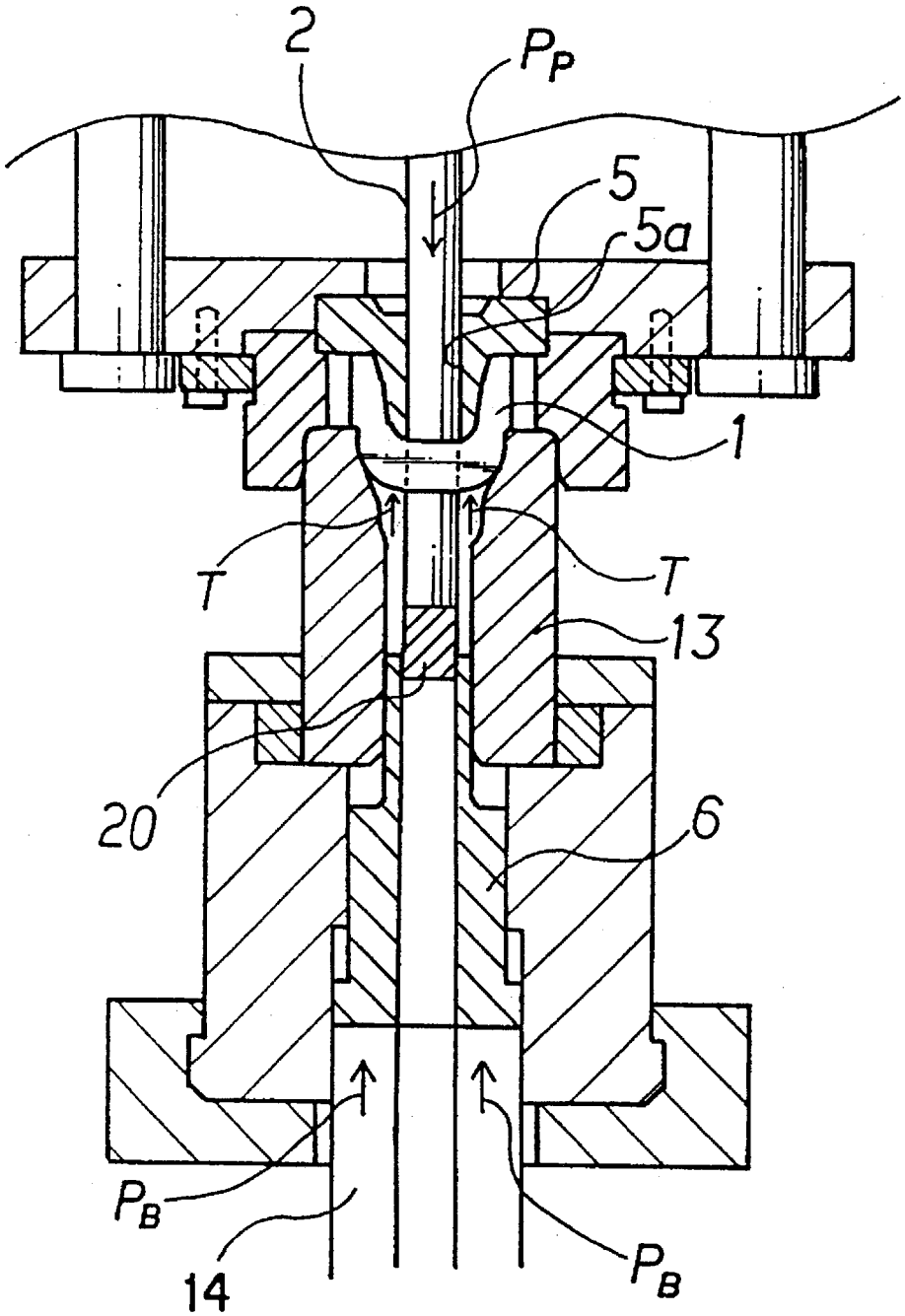
FIG. 2 also illustrates a schematic view of main portion showing one operative step of the apparatus shown in FIG. 1.

Although the lower plate 7 is stopped at the described position, the piercing punch 2 continues to move down for piercing. As shown in FIG. 2, the piercing punch 2 passes through the hole 5*a* of the holding guide 5 and thus moves down through the hole 5*a* in order to be constrained with the hole 5*a* against transverse displacement. Thereby buckling deformation of the piercing punch is minimized which results in high working accuracy. The clearance between the piercing punch 2 and the hole 5*a* of the holding guide is as slight as possible so far as the piercing punch can move therethrough, and therefore the cross section of the hole 5*a* is slightly larger than that of the punch 2.

The applying unit 15 is actuated simultaneously with the start of piercing stroke and backup pressure is applied on the blank 1 through the tubular member 14 and the receiver die 6. With the progress of the piercing stroke, the receiver die 6 is lowered until it reaches the fixed die 30. FIG. 2 shows a halfway state of the piercing stroke. When the piercing punch 2 moves down to the lower end or a position adjacent thereto passing the position shown in FIG. 2, the tip of the punch 2 enters the hole 6a of the receiver die 6 to cut off redundant piece 20 so as to pierce the blank through.

To effect such piercing through, the clearance between the through-hole 6*a* of the receiver die and the piercing punch 2 should be of a suitable dimension. An example of the clearance, according to the data described later (Table 1), it takes 0.5 mm, while the said clearance can be taken in a range of from 0.1 mm to 0.8 mm. In case that the clearance is less than 0.1 mm, the receiver die hole 6*a* and the piercing punch 2 will be worn away, whereas the clearance exceeding 0.8 mm results in incomplete cutting off of the redundant piece and therefore good piercing through can not be attained. The reason why the tip of the punch 2 at the stroke end can enter the hole 6*a* of the receiver die 6 with a suitable clearance is based on the fact that, as described above, the piercing punch 2 is guided with the hole 5*a* of the holding guide thus minimizing transverse displacement (buckling deformation) of the punch 2.

As an example, we used, as a hot blank, a forged sleeve York of drive shaft used in a truck and carried out the piercing by means of 600 ton working press. The relevant data are shown in Table 1.

TABLE 1

Dimensions of blank (mm)

(1) Total length (L1):216
Length of cylindrical portion (L2):150
Length of branch portion (L3):66

(2) Outer diameter of cylindrical portion (R1):55
Inner diameter of cylindrical portion (R2):33
1/d (=L2/R2) length of cylindrical portion (L2)/Inner diameter of cylindrical portion (R2)=150/33=4.5.

Dimensions of working machine's main parts (mm)

Outer diameter of upper die:300

Outer diameter of lower die:220

Outer diameter of holding guide:180

Inner diameter of lower receiver die:34

Outer diameter of piercing punch:33

Movements of working machine (mm)

Clamp stroke:360

Piercing stroke:250

Total stroke:610

Stroke of lower receiver die:35

Material of blank: S35C

Working temperature:700–1,100° C.

Figure 4:
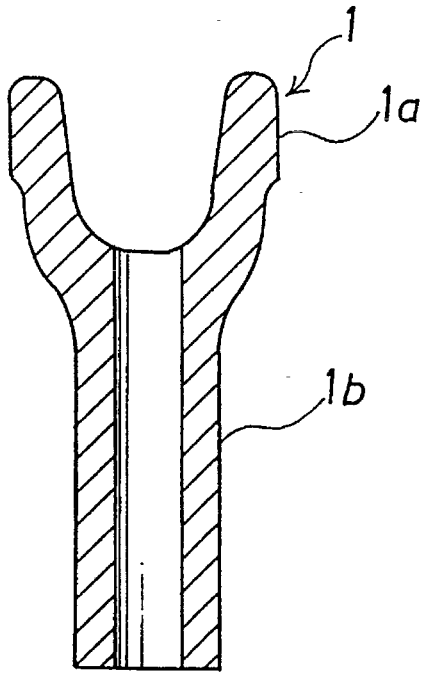
FIG. 4 illustrates a section showing an example of a pierced blank according to the invention.

Compared with conventional values, the maximum deviation of thickness (maximum thickness–minimum thickness) was less than 1.0 mm, whereas conventional maximum deviation was 2.0 mm or more. And, as for deviation of the axis of the piercing punch, it was less than 0.5 mm, while a conventional value was 1.0 mm or more. Also, as for the occurrence of narrow ring and variation of the length, they are considerably decreased in comparison with conventional values. Also, deformation of a branch (enlarged portion) of sleeve York was limited less than 1.0 mm. An example of a pierced sleeve York according to our piercing process is shown in FIG. 4.

Figure 5:
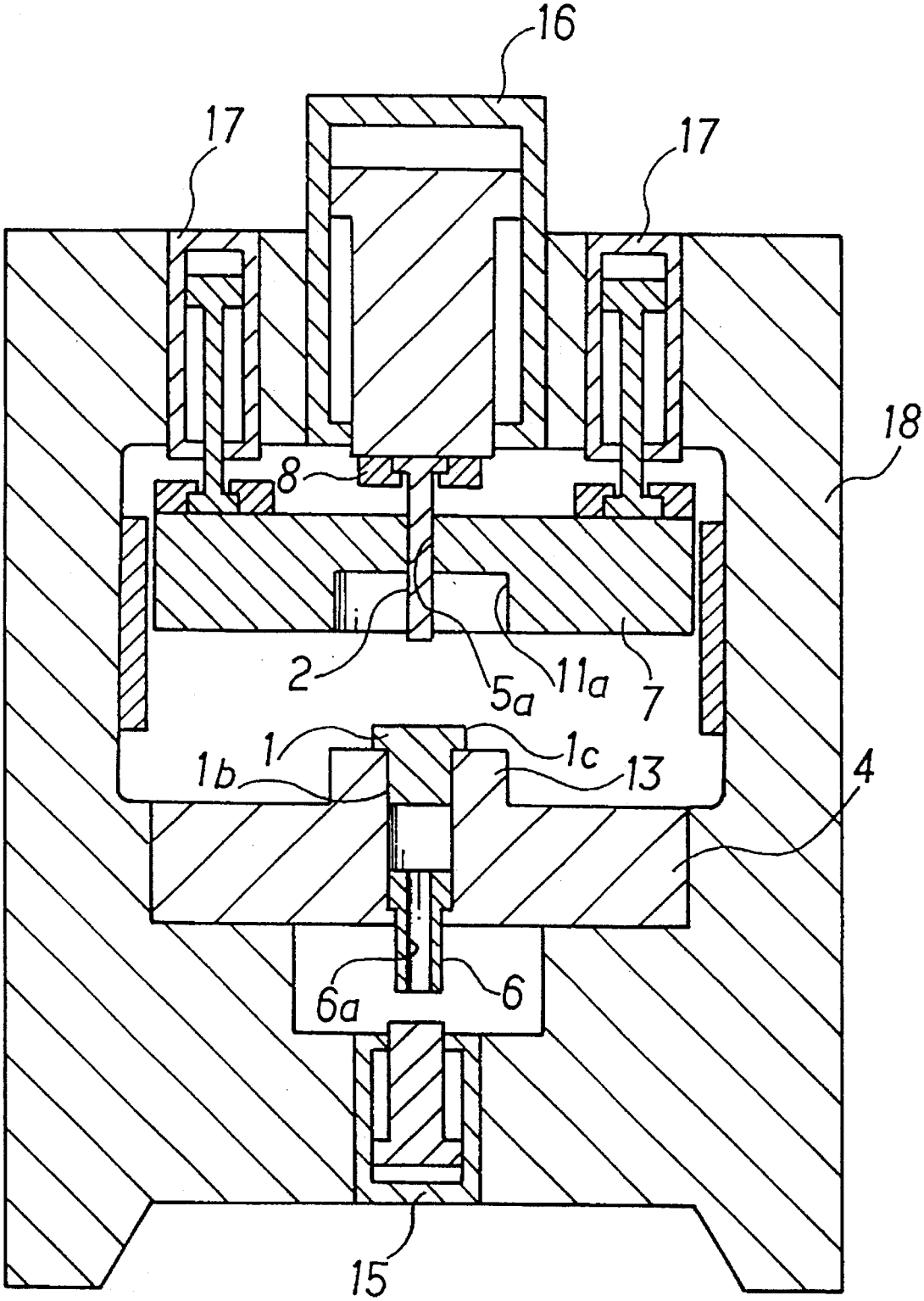
FIG. 5 illustrates a sectional view showing another embodiment of the apparatus used for the piercing process according to the invention.
Figure 6:
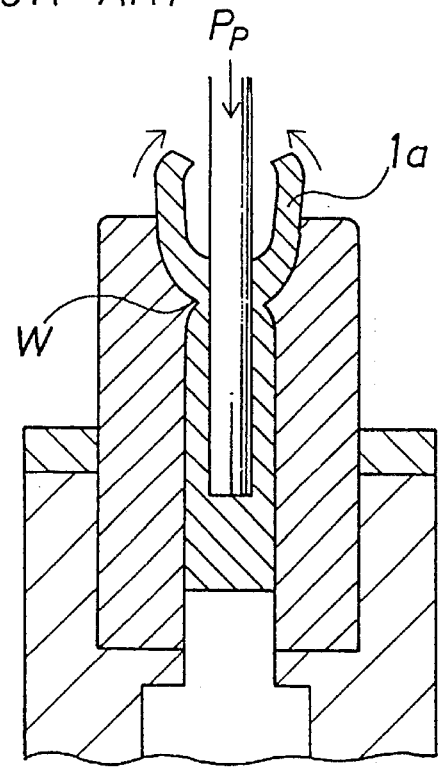
FIG. 6 PRIOR ART
FIG. 6 illustrates a partial sectional view showing one step of a prior art piercing process.
Figure 7A:
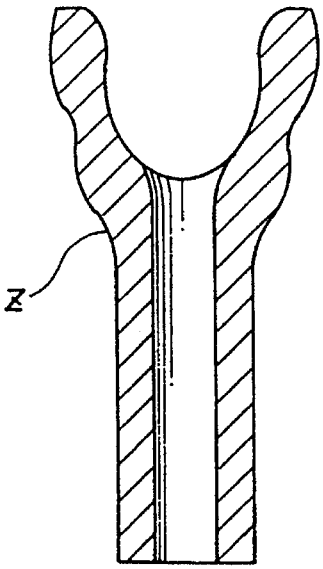
FIG. 7(a) PRIOR ART
FIG. 7 (*a*) illustrates a sectional view showing a blank pierced according to prior art.
Figure 7B:
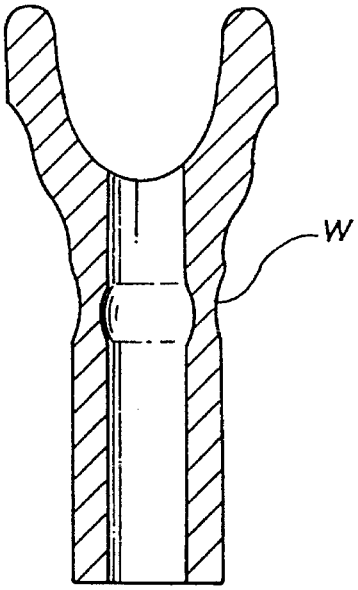
FIG. 7(b) PRIOR ART

FIG. 5 shows another example of the apparatus for the piercing process according to the invention. In this apparatus, the lower die 13 is formed integrally with the lower die assembly 4 and the holding guide 5 is also integral with the holder member 7. And, oil cylinders are used as the respective actuators, so that the piercing punch 2 and the mounting member 8 there for are attached to the lower end face of the actuating part of oil cylinder 16. The holder member 7 is adapted for up and down movement by a pair of oil cylinders 17. Another oil cylinder is used as the backup pressure applying unit 15. These constituent members and units are disposed within the body 18.

In this apparatus, the pair of oil cylinders 17 are actuated to lower the holder member 7 onto the lower die assembly 4, then an enlarged portion of blank is held by the holding guide of the holder member. Next, the piercing punch 2 moves down by actuation of the oil cylinder 16 to perform the piercing of the blank 1, and simultaneously with the piercing stroke, backup pressure is applied on the blank. The piercing punch 2 is similarly guided with the hole 5*a* of the holder member 7 and at the lower stroke end, enters the hole 6*a* of the receiver die 6 disposed in the lower die assembly 4 in order to cut off the redundant piece.

In this piercing process, any blanks can be pierced either ferrous metallic or non-ferrous metallic ones such as aluminum, copper, etc.. Incidentally, the piercing process of the invention is based on hot piercing, the working temperature being in a no more than the usual forging temperature. Preferable in a range of from the usual forging temperature to half of the usual forging temperature. Accordingly, a hot blank after having been forged can be pierced with use of the remaining heat of the blank in order to save heating energy.

As mentioned above, in the piercing process according to the invention, because the piercing punch is guided and held with the through-hole of the holding guide to minimize transverse displacement of the punch, it is possible to pierce such a long hole having a slenderness of 5 or so in a blank with high working accuracy. This leads to a high yield. Also, application of backup pressure on the blank prevents occurrence of narrow ring and deformation. Further, because the piercing punch enters the hole of the receiver die at the lower stroke end to cut off redundant of blank, piercing of through-hole is performed by one stroke, which improves the productivity considerably. Furthermore, this piercing process reduces the quantity of redundant pieces of the blank comparing with that by drilling, and can pierce not only circular holes but also square or polygonal holes, While there is shown and described herein certain specific structures embodying this invention for the purpose of clarity of understanding, the same is to be considered as illustrative in character, it being understood that only preferred embodiments have been shown and described. It will be manifest to those skilled in the art that certain changes, various modifications and rearrangements of the parts may be made without departing from the spirit and scope of the underlying inventive concept and that the same is not limited to the particular forms herein shown and described except insofar as indicated in the scope of the appended claims.

What is claimed is:

1. In a method for forward extrusion and piercing a hot blank positioned on a lower die assembly by downward movement of a piercing punch attached to an upper die assembly, said hot blank forged as having a determined outer shape with a shaft at one end thereof such that a slenderness determined by a ratio of pierced length to pierced hole diameter is greater than four, said method comprising the steps of:

lowering a holding guide disposed on the upper die assembly onto said lower die assembly just before the forward extrusion and piercing, forward extrusion and piercing said hot blank by downward movement of said punch which passes through a through-hole of said holding guide, in the forward extrusion piercing stroke, said through-hole of the holding guide serving to guide said piercing punch to thereby prevent transverse displacement of the punch, applying backup pressure on the blank at the lower end thereof only in the time interval during the forward extrusion portion of the piercing stroke whereby cooperation of the forward extrusion piercing action and the applied backup pressure effects the forward extrusion of said blank having the slenderness of greater than four, said application of the backup pressure being done through a receiver die which receives said blank, the tip portion of the punch being adapted to enter a through-hole of said receiver die when said punch moves down to one of the lower stroke end and a position adjacent thereto.

2. The method set forth in claim 1 wherein said holding guide holds an enlarged portion of the blank positioned on the lower die assembly when the guide is lowered onto said lower die assembly.

3. In an apparatus for forward extrusion and piercing of a hot blank, said blank forged as having a determined outer shape with a shaft at one end thereof such that a slenderness determined by a ratio of pierced length to pierced hole diameter is greater than four, which includes a lower die assembly for supporting said blank, an upper die assembly located above the lower die assembly and having a piercing punch attached thereto for piercing said blank, and actuator means for driving said upper die assembly up and down, the improvement comprising:

said upper die assembly having a holder member provided with a holding guide for holding an uppermost positioned enlarged portion of said blank between said upper and lower die assemblies and a mounting member attached with the piercing punch, said mounting member being adapted to move up and down above said holding member, said holding guide being formed with a through-hole through which said piercing punch passes, said through-hole of the holding guide having a cross section slightly larger than the cross section of the punch so as to guide the piercing punch to prevent transverse displacement thereof, and said apparatus further comprising applying means located below said lower die assembly for applying backup pressure on said blank through a receiver die only in the time interval during the forward extrusion portion of the piercing stroke whereby cooperation of the forward extrusion piercing action and the applied backup pressure effects the forward extrusion of said blank having the slenderness of greater than four, said receiver die being adapted for up and down movement in the lower die assembly and having a through-hole coaxial with the through-hole of said holding guide so that the piercing punch enters the through-hole of the receiver die at one of the lower stroke end and a position adjacent thereto.

4. The apparatus set forth in claim 3 wherein said holding guide is releasably mounted on the holder member.

5. The apparatus set forth in claim 3 wherein said holding guide is formed integrally with the holder member which comprises a plate.

6. The apparatus set forth in claim 3 wherein said actuator means for the upper die assembly includes at least one actuator for said holder member and an actuator for said mounting member.

7. The apparatus set forth in claim 6 wherein the respective actuators for the holder member and the mounting member are oil-cylinders.

8. The apparatus set forth in claim 3 wherein said means for applying backup pressure is an oil-cylinder.

9. The apparatus set forth in claim 3 wherein the clearance between the through-hole of the receiver die and the piercing punch is in a range of from 0.1 mm to 0.8 mm.

* * * * *